US005253598A

United States Patent [19]

Rinehuls

[11] Patent Number: 5,253,598

[45] Date of Patent: Oct. 19, 1993

[54] METHOD FOR MANUFACTURING HATS

[75] Inventor: Hans Rinehuls, West Palm Beach, Fla.

[73] Assignee: Jass Concepts, West Palm Beach, Fla.

[21] Appl. No.: 818,176

[22] Filed: Feb. 28, 1992

[51] Int. Cl.[5] ..... A42C 5/02

[52] U.S. Cl. ..... 112/263.1; 112/265.1; 2/181; 2/184

[58] Field of Search ..... 2/181, 181.2, 184, 192, 2/181.4, 181.6, 181.8, 171; 112/171.2, 263.1, 262.1, 265.1, 12

[56] References Cited

U.S. PATENT DOCUMENTS

| | | | |
|---|---|---|---|
| 890,696 | 6/1908 | Nichols | 2/181 |
| 935,832 | 10/1909 | Barnes | 2/171.2 |
| 2,044,038 | 6/1936 | Wintjen | 2/181 |
| 2,155,965 | 4/1939 | Bracher | 2/181 |
| 2,178,495 | 10/1939 | Rolnick | 2/181 |
| 2,242,338 | 5/1944 | Augitto | 2/181 |
| 2,616,090 | 11/1952 | Xeros | 2/181 |
| 2,820,226 | 1/1958 | Topiel et al. | 2/181 |
| 3,280,406 | 10/1966 | Immel | 2/181 |

FOREIGN PATENT DOCUMENTS

| | | | |
|---|---|---|---|
| 679488 | 8/1939 | Fed. Rep. of Germany | 2/181 |

*Primary Examiner*—Clifford D. Crowder
*Assistant Examiner*—Larry D. Worrell, Jr.
*Attorney, Agent, or Firm*—Malin, Haley, DiMaggio & Crosby

[57] ABSTRACT

The present invention discloses an improved method of installing sweatbands or the like in non-sized hats. The band and fabric may be installed in the crown of a hat by a novel rolling process which saves time and expense, while leaving a seamless finish in the area of the soft cloth.

13 Claims, 3 Drawing Sheets

14
24
28
20
12
22
26
18
16
29
27
STEP 1
11

28
12
18
30
STEP 2
34
32
11
10

12
STEP 3
11

12
18
36
36
STEP 4
11

14' 24'
12'
20'
22'
26'
18'
STEP 1
11'

18'
12'
30'
STEP 2
34'
32'
11'

10'
12
STEP 3
11

18
12'
30'
REMOVE
STEP 4
35'
11'

METHOD FOR MANUFACTURING HATS

BACKGROUND OF THE INVENTION

1. Field of the Invention

This invention relates generally to a method of fabricating hats, and more particularly, to an improved method of installing a sweat band in the crown of a non-sized hat.

2. Description of the Prior Art

A hat configuration having a sweat band installed in the crown area immediately adjacent the brim area is well known in the art. In hats which are designed to fit a particular head size, the sweat band is typically fabricated from an elongated strip of semi-rigid material, and then stitched to the inner surface of the crown by a special machine in parallel orientation around the entire crown periphery. One size fits all hats are not usually constructed having a semi-rigid band installed in the crown, which further has a leather fabric such as soft cloth (Ultrasuede) or the like, wrapped around a segment thereof so as to provide additional comfort when the hat is worn. This embodiment is usually fabricated by fastening the band around its external periphery to the inner crown surface of the hat by either bonding or riveting, or a combination thereof, and subsequently attaching a segment of soft cloth thereto after the band is secured to the crown. This procedure has disadvantages. The primary drawback associated with the foregoing process is that it is labor intensive. The band must be carefully aligned with the crown when it is secured to the crown surface, often requiring special equipment and/or additional manpower. Another detriment of this manufacturing scheme is the exposed edge between the band and crown surface which remains after final assembly.

The instant invention is directed to the foregoing concerns by providing an improved process of manufacture for hats, wherein the band and fabric may be installed in the crown by a novel rolling process which saves time and expense, while leaving a seamless finish in the area of the soft cloth.

SUMMARY OF THE INVENTION

The present invention discloses an improved method of installing sweat bands in non-sized hats. The method of manufacture comprises the steps of: trimming a piece of fabric to size in proportion to the size of the hat; positioning the fabric relative to a semi-rigid and elongated band, e.g., centered; fastening the band near one side of the fabric; positioning the band and attached fabric relative to the inner crown surface of the hat; fastening the fabric near its other side to the inner crown surface; folding the band two times about its longitudinal axis toward and into the crown, and rigidly fastening the band to the inner crown surface at opposing radial locations.

In an alternative embodiment, a process for manufacturing hats having sweat bands fabricated entirely from fabric is disclosed, comprising the steps of: trimming the fabric to size in proportion to the hat, positioning the fabric relative to the inner crown surface; fastening the fabric near one end to the crown surface at a first location; positioning a semi-rigid stay against the fabric near its other end; folding the stay two times about its longitudinal axis toward and into the crown; and fastening the fabric to the crown surface at a second location.

In accordance with the foregoing, it is an object of the present invention to provide a means for manufacturing hats, wherein a sweat band may be installed therein by a novel non-labor intensive rolling process.

It is a further object of the instant invention to disclose a method of installing a sweat band constructed entirely from fabric, by using a stay in conjunction with a novel non-labor intensive rolling process.

In accordance with these and other objects which will become apparent hereinafter, the instant invention will now be described with particular reference to the accompanying drawings.

DETAILED DESCRIPTION OF THE PREFERRED EMBODIMENT

Figures 1, 2, 3, 4:
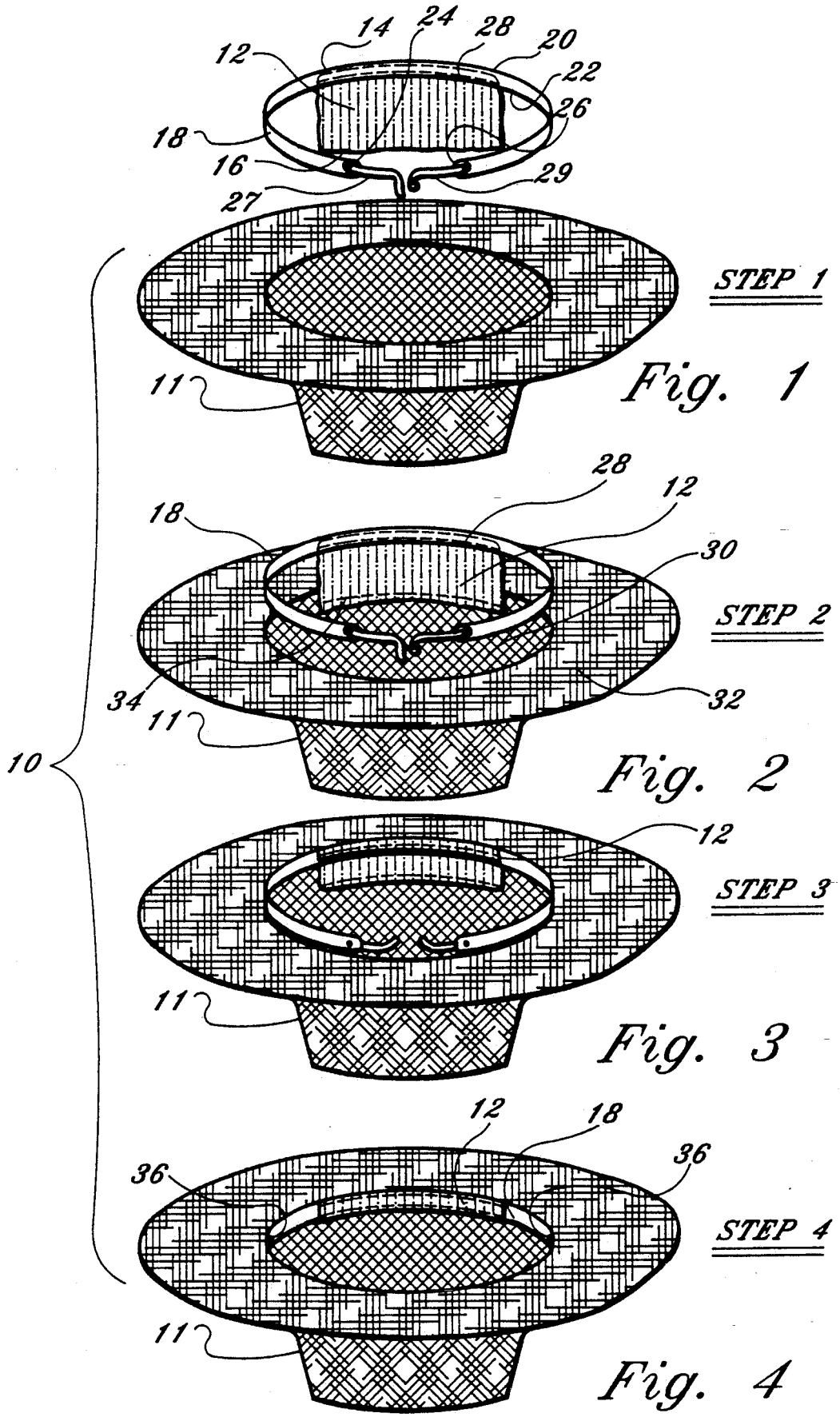
FIG. 1 is a isometric view of step 1, wherein the fabric is fastened to the band.
FIG. 2 is an isometric view of step 2, wherein the fabric is fastened to the crown of the hat.
FIG. 3 is an isometric view of step 3, wherein the band is rolled a first time about its longitudinal axis.
FIG. 4 is an isometric view of step 4, wherein the band is rolled a second time about its longitudinal axis and secured to the crown surface.

With reference to the several views of the drawings, there is depicted generally a method 10 for fabricating non-sized hats, and more particularly a method of installing a sweat band in a hat.

The process is comprised of the following steps. After trimming a piece of fabric 12 such as soft cloth to a desired size in proportion to a hat to be fabricated 11, the fabric 12, having a first end 14, and a second end 16, is ready to be fastened to a band 18, band 18 being a generally elongated semi-rigid member having a top edge 20, a bottom edge 22, and two side edges 24 and 26. The band 18 further comprises attachment strap means 27 and 29 having opposing patches of hook and loop material 31 and 33 respectively disposed on opposing faces in a manner well known in the art. In step 1 as illustrated in FIG. 1, fabric 12 is fastened to band 18 by an attachment means such as stitching 28, wherein fabric 12 is stitched to band 18 near first end 14 of fabric 12, and adjacent band bottom edge 22 a nominal distance therefrom and disposed approximately in the center of band 18 equadistant from side edges 24 and 26 respectively.

Figure 5:
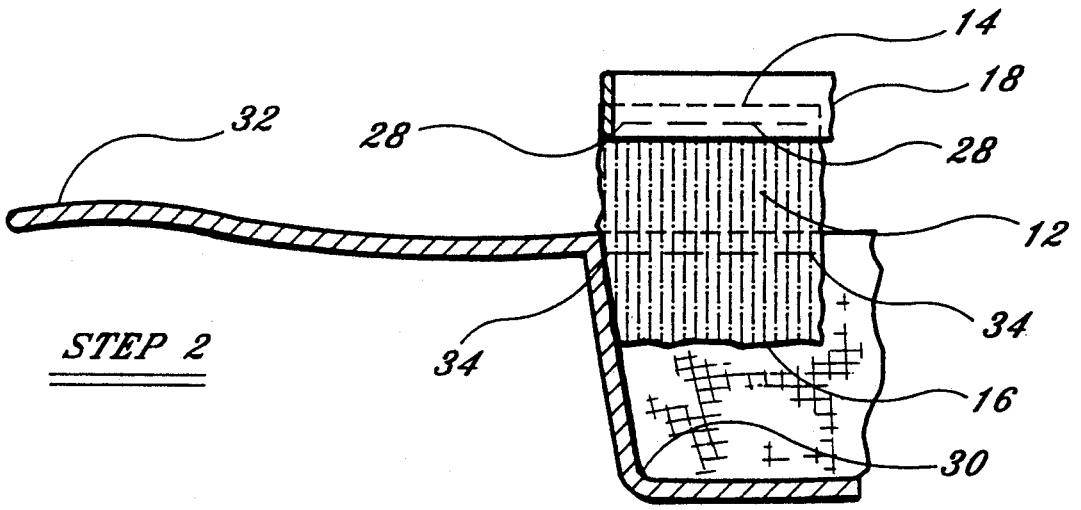
FIG. 5 is a sectional view of FIG. 2.

In step 2 illustrated in FIGS. 2 and 5, band 18 and attached fabric 12, are positioned relative to the inner crown surface 30 and the brim surface 32.

Fabric 12 is subsequently fastened to inner crown surface 30 by an attachment means such as stitching 34, near second end 16, a nominal distance adjacent brim surface 32.

Figure 6:
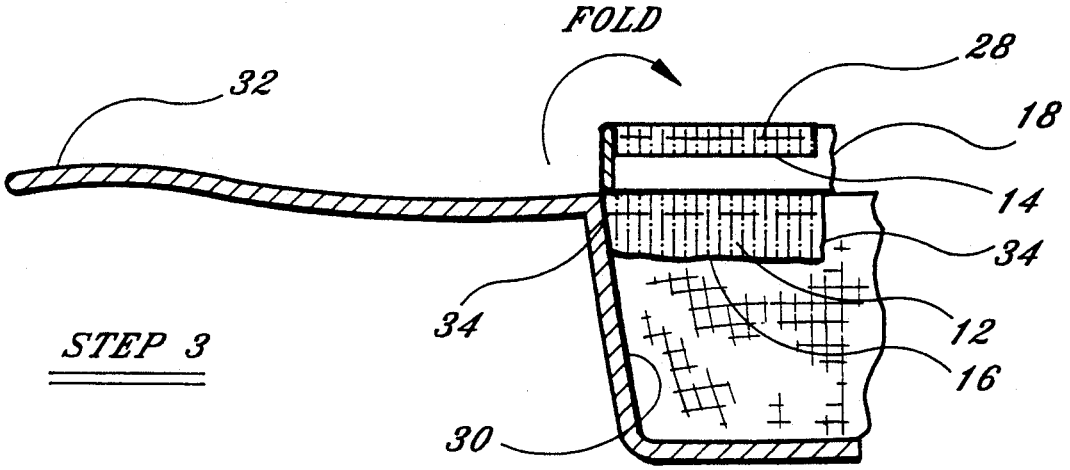
FIG. 6 is a sectional view of FIG. 3.

FIGS. 3 and 6, depict step 3, the first iteration of the rolling process, wherein band 18 is rolled about its longitudinal axis toward and into the crown portion of hat 11 This is easily accomplished by pulling fabric 12 taut against stitch line 34, and simply folding band 18 one time about its longitudinal axis.

Figure 7:
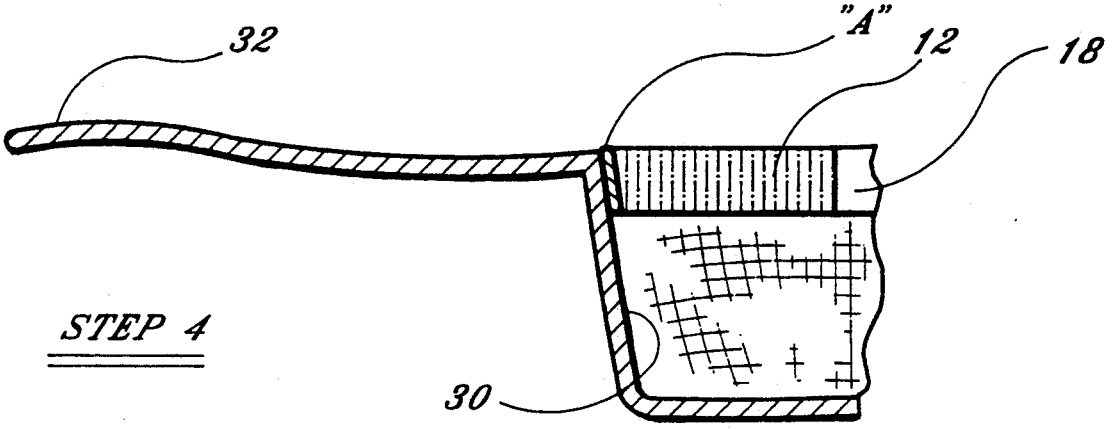
FIG. 7 is a sectional view of FIG. 4.

Step 4 is disclosed in FIGS. 4 and 7, wherein band 18 undergoes a second iteration of the rolling process by folding band 18 a second time about its longitudinal axis into the crown portion of hat 11, and against inner crown surface 30. Band 18 is subsequently rigidly secured to inner crown surface 30 by fastening means such as a rivet 36. Band 18 may be alternately attached to inner crown surface 30, by tack stitching if desired or by bonding, without departure from the scope of the invention. It is important to note, that all stitch lines may have an alternative method of fastening substituted therefor. The end result of the foregoing process results in an appearance of a seamless interface between band 18 and inner crown surface 30, denoted as area "A" as shown in FIG. 7, since fabric 12 is entirely wrapped around band 18, thereby affording the wearer a maximum degree of comfort when worn.

Figures 8, 9, 10, 11:
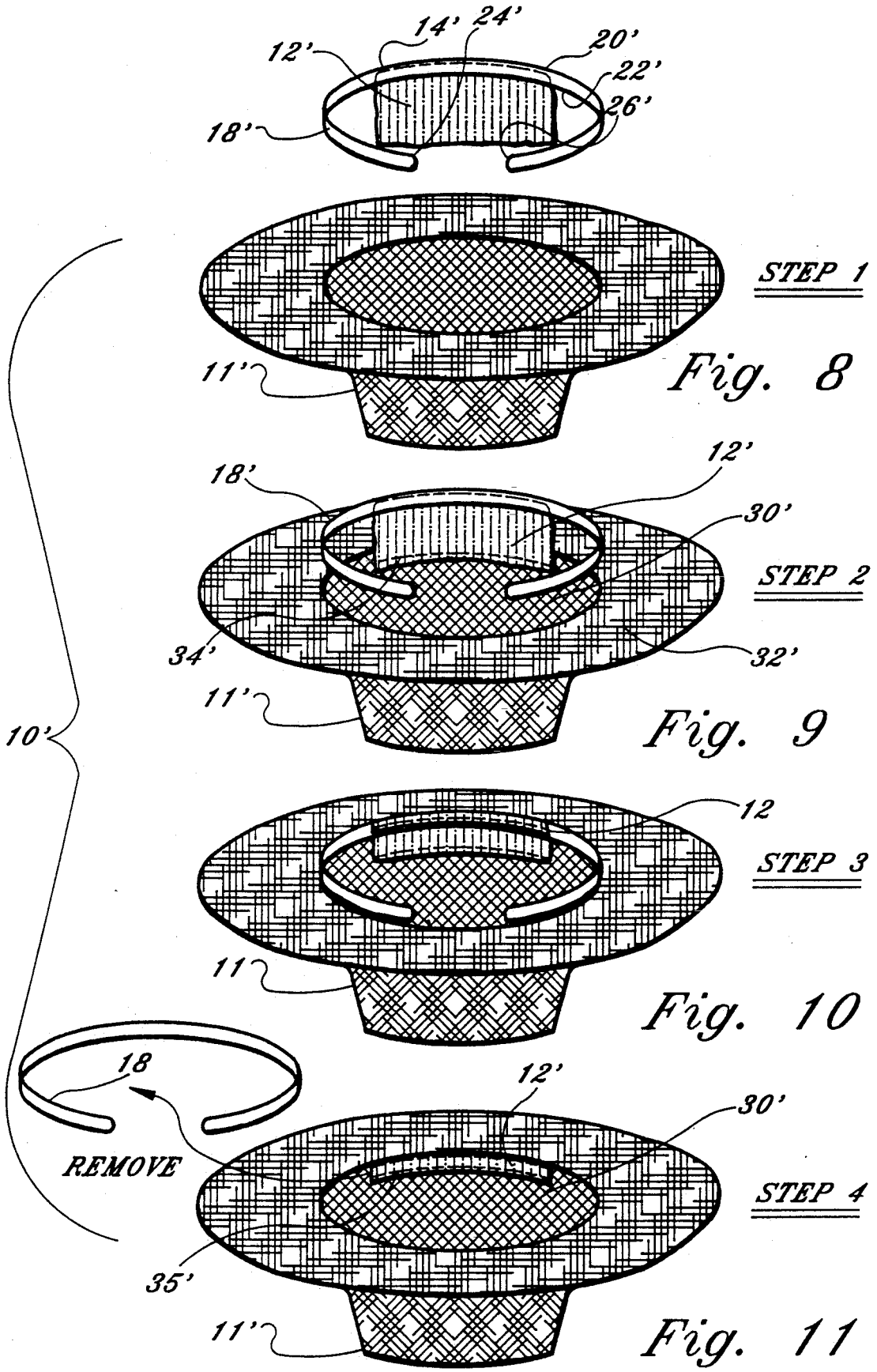
FIG. 8 is an isometric view of the alternative embodiment of step 1.
FIG. 9 is an isometric view of the alternative embodiment of step 2.
FIG. 10 is an isometric view of the alternative embodiment of step 3.
FIG. 11 is an isometric view of the alternative embodiment of step 4.

In the alternative embodiment depicted in FIGS. 8 through 11, a method of installing an all-fabric sweat band 12' is disclosed. Subsequent to trimming a piece of fabric 12' such as soft cloth, in proportion to hat 11', step 1 shows fabric 12' being oriented relative to the inner crown surface 30' of hat 11' and semi-rigid stay 18'. In step 2, as shown in FIG. 9, fabric 12' is fastened to inner crown surface 30' by attachment means such as stitching 34' at a first location near second end 16', a nominal distance adjacent brim surface 32'.

FIG. 10 depicts step 3, wherein fabric 12' is rolled onto itself by folding the semi-rigid stay 18' once about its longitudinal axis. The stay 18' is subsequently rolled a second time until the fabric 12' assumes the shape of a rectangular elongated strip as shown in FIG. 11. While maintaining pressure on fabric 12' to keep it in intimate contact with inner crown surface 30', fastening means such as stitch lines 35' are added at a second location near said fabric first end 14', a distance greater than the nominal distance between the first location and brim surface 32'.

In a further alternative embodiment employing the same process steps as described above and depicted in FIGS. 8–11, when using a soft band material, such as cloth or the like, which does not have enough rigidity to maintain form, a stay can be utilized as depicted in FIG. 11. This will provide a sufficient degree of support for the manufacturing process described herein.

The instant invention has been shown and described herein in what is considered to be the most practical and preferred embodiment. It is recognized, however, that departures may be made therefrom within the scope of the invention and that obvious modifications will occur to a person skilled in the art.

I claim:

1. A method of installing a band in a hat, comprising the steps of:

(a) positioning a piece of fabric relative to a semi-rigid band, said fabric having a first end and a second end, said band having a top edge, a bottom edge and two side edges;

(b) fastening said fabric near said first end to said band, said fabric being between said side edges, said fabric further being adjacent said bottom edge and a nominal distance therefrom;

(c) positioning said band and attached fabric relative to a hat, said hat having a crown portion defined by a crown surface, and a brim surface disposed substantially normal to said crown surface;

(d) fastening said fabric near said second end to said crown surface a nominal distance form said brim surface;

(e) rotating said band two times about its longitudinal axis toward and into said hat crown portion; and (f) fastening said band to said crown surface of said hat.

2. The method of installing a band in a hat as recited in claim 1, wherein the step of fastening said fabric to said band comprises stitching thereto.

3. The method of installing a band in a hat as recited in claim 1, wherein the step of fastening said fabric to said band comprises bonding thereto.

4. The method of installing a band in a hat as recited in claim 1, wherein the step of fastening said fabric to said crown surface comprises stitching thereto.

5. The method of installing a band in a hat as recited in claim 1, wherein the step of fastening said fabric to said crown surface comprises bonding thereto.

6. The method of installing a band in a hat as recited in claim 1, wherein the step of rigidly fastening said band to said crown surface comprises tack stitching thereto.

7. The method of installing a band in a hat as recited in claim 1, wherein the step of rigidly fastening said band to said crown surface comprises riveting thereto.

8. The method of installing a band in a hat as recited in claim 1, wherein the step of rigidly fastening said band to said crown surface comprises bonding thereto.

9. The method of installing a band in a hat as recited in claim 1, further comprising the step of trimming said piece of fabric to size in proportion to said hat crown size prior to positioning said fabric relative to said band.

10. A method of installing a fabric band in a hat, comprising the steps of:

(a) orienting a piece of fabric relative to a hat, said fabric having a first end and a second end, said hat having a crown portion defined by a crown surface, and a brim surface disposed substantially normal to said crown surface;

(b) fastening said fabric at a first location near said fabric second end to said crown surface a nominal distance from said brim surface;

(c) positioning a semi-rigid stay relative to said fabric first end, said stay having a top edge, a bottom edge and two side edges, wherein said stay bottom edge is disposed a nominal distance form and is adjacent to said fabric first end;

(d) rotating said stay two times about its longitudinal axis toward and into said hat crown portion;

(e) removing said stay from within said fabric, while maintaining said fabric in intimate contact with said crown surface; and (f) fastening said fabric to said crown surface at a second location near said fabric first end a distance greater than said nominal distance between said first location and said brim surface.

11. The method of installing a fabric band in a hat as recited in claim 10, wherein said fastening said fabric to said crown surface at said first location comprises stitching thereto.

12. The method of installing a fabric band in a hat as recited in claim 10, wherein said fastening of said fabric to said crown surface at said second location comprises stitching thereto.

13. A method of installing a ban in a hat, comprising the steps of:

(a) trimming a portion of soft cloth to size in proportion to a hat, said soft cloth having a first and a second end, said hat having a crown portion defined by a crown surface, and a brim surface disposed substantially normal to said crown surface;

(b) positioning said piece of soft cloth relative to a semi-rigid band, said band having a top edge, a bottom edge and two side edges;

(c) stitching said soft cloth near said first end to said band, said soft cloth being between said side edges, said soft cloth further being adjacent said bottom edge and a nominal distance therefrom;

(d) positioning said band and attached soft cloth relative to said hat;

(e) stitching said soft cloth near said second end to said crown surface a nominal distance from said brim surface;

(f) rotating said band two times about its longitudinal axis toward and into said hat crown portion; and (g) riveting said band to said crown surface of said hat.

* * * * *